US005188916A

United States Patent [19]

Hodumi et al.

[11] Patent Number: 5,188,916

[45] Date of Patent: Feb. 23, 1993

[54] ELECTROPHOTOGRAPHIC PHOTORECEPTOR HAVING A ZIRCONIUM AND SILICON-CONTAINING UNDERLAYER

[75] Inventors: Masahiko Hodumi; Koji Bando; Takahiro Suzuki; Shigeto Hashiba; Yoshiyuki Ono; Sadao Okano; Seiji Ashiya; Masanori Murase, all of Kanagawa, Japan

[73] Assignee: Fuji Xerox Co., Ltd., Tokyo, Japan

[21] Appl. No.: 757,028

[22] Filed: Sep. 9, 1991

[30] Foreign Application Priority Data

Oct. 8, 1990 [JP] Japan ..... 2-268315
Oct. 26, 1990 [JP] Japan ..... 2-287232

[51] Int. Cl.[5] ..... G03G 5/14
[52] U.S. Cl. ..... 430/65; 430/60
[58] Field of Search ..... 430/60, 62, 63, 64, 430/65

[56] References Cited

U.S. PATENT DOCUMENTS 4,906,545 3/1990 Fukagai et al. ..... 430/63
4,957,839 9/1990 Rokutanzono et al. ..... 430/66

*Primary Examiner*—John Goodrow
*Attorney, Agent, or Firm*—Finnegan, Henderson, Farabow, Garrett and Dunner

[57] ABSTRACT

A novel electrophotographic photoreceptor is disclosed, comprising an undercoating layer provided on an electrically conductive substrate having thereon a light-sensitive layer, wherein the undercoating layer is obtained by coating a solution of a composition comprising zirconium and silicon or a solution of a mixture of a zirconium acetyl acetonate compound and a silane coupling agent, the silicon content in the composition comprising zirconium and silicon is in the range of 5 to 35 mol % based on the total amount of zirconium and silicon, and the hardened undercoating layer obtained from the zirconium acetyl acetonate compound and silane coupling agent is a layer having a hardening degree of 1.2 or less.

4 Claims, 2 Drawing Sheets

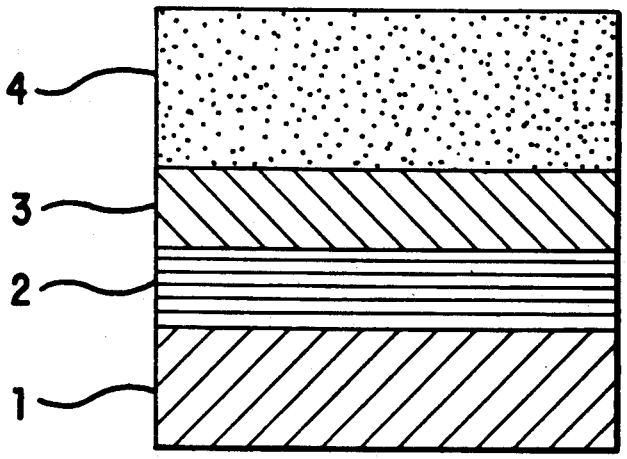
FIG. 1-(a)
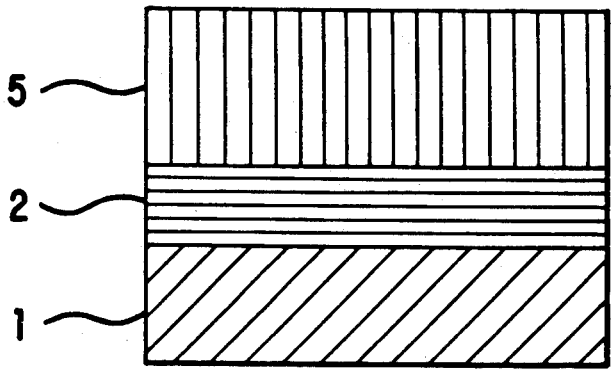
FIG. 1-(b)
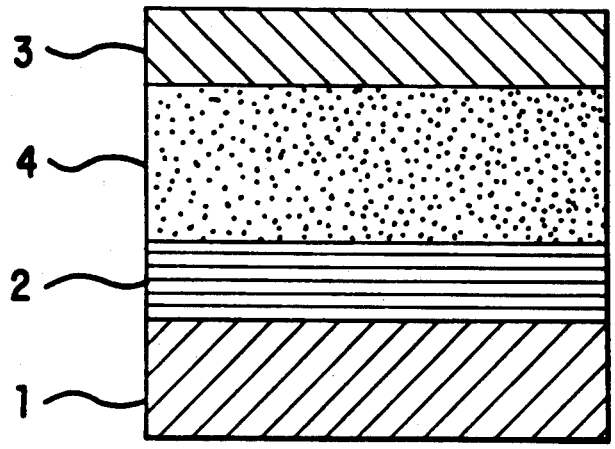
FIG. 1-(c)

ELECTROPHOTOGRAPHIC PHOTORECEPTOR HAVING A ZIRCONIUM AND SILICON-CONTAINING UNDERLAYER

FIELD OF THE INVENTION

The present invention relates to an electrophotographic photoreceptor comprising an electrically conductive substrate, an undercoating layer and a light-sensitive layer. More particularly, the present invention relates to an electrophotographic photoreceptor comprising an improved undercoating layer.

BACKGROUND OF THE INVENTION

In electrophotographic copying machines, copying speed has been increased year after year. Further, in electrophotographic copying machines which can be used with various paper sizes, photoreceptors having a high light sensitivity and a prolonged life have been desired.

Many function-separation type electrophotographic photoreceptors comprising a plurality of members each having functions have been proposed for improvements in electrophotographic properties such as charge retention, stability for repeating use, light response, spectral properties and mechanical strength.

These electrophotographic photoreceptors have been known disadvantageous in that they lack stability for repeating use or environmental stability of development contrast, they are subject to image defects such as white pepper, black pepper, roughness and pinholes and they exhibit so low an adhesion strength between the substrate and the light-sensitive layer that the light-sensitive layer is peeled off during use, showing insufficient durability.

In order to eliminate these disadvantages, it has been proposed to provide a resin layer as an undercoating layer between the substrate and the light-sensitive layer. As such resins there have been known polyparaxylene, casein, polyvinyl alcohol, phenol resin, polyvinyl acetal resin, melamine resin, nitrocellulose, ethylene-acrylic acid copolymer, polyamide (e.g., nylon 6, nylon 66, nylon 610, copolymer nylon, alkoxymethylated nylon), polyurethane, gelatin, polyvinyl pyrrolidone, polyvinyl pyridine, and polyvinyl methyl ether.

Further, many proposals have been made to form an interlayer from zirconium chelate compounds, organic zirconium compounds such as zirconium alkoxide or silane coupling agents as described in JP-A-59-223439, 61-94057, and . 62-273549 (the term "JP-A" as used herein means an "unexamined published Japanese patent application").

In the case where a resin layer is provided as an undercoating layer, a resin containing a relatively large amount of polar groups is mainly incorporated therein so that the volume resistivity thereof is controlled to a low level to such an extent that the electrophotographic properties are not deteriorated. However, since the volume resistivity of a resin greatly depends on the ionic conductivity and is thus extremely affected by temperature and humidity, the resin layer under low temperature and humidity or high temperature and humidity conditions exhibits a remarkably high resistivity which deteriorates the electrophotographic properties of the light-sensitive layer or a remarkably low resistivity which eliminates the desired functions of the resin layer.

Therefore, the above mentioned known resin layer can eliminate only part of disadvantages of photoreceptors. If environmental properties are included, the effects of this approach are halved. Thus, this approach is extremely insufficient.

As mentioned above, the conventional undercoating layer leaves much to be desired as an undercoating layer for eliminating various disadvantages of photoreceptors. Thus, the properties of the conventional electrophotographic photoreceptors are insufficient.

SUMMARY OF THE INVENTION

An object of the present invention is to provide an electrophotographic photoreceptor which exhibits reduced dark decay, an excellent chargeability and reduced drop in development contrast and especially exhibits decreased residual potential.

Another object of the present invention is to provide an electrophotographic photoreceptor scarcely having image defects such as white pepper, black pepper, roughness and pinholes.

A further object of the present invention is to provide an electrophotographic photoreceptor which exhibits reduced environmental fluctuation and an excellent durability in electrophotographic properties.

These and other objects of the present invention will become more apparent from the following detailed description and examples.

As a result of studies, the present inventors found that these objects of the present invention can be accomplished by forming an undercoating layer of a solution of a composition comprising specified proportions of silicon and zirconium or a solution of a mixture of a zirconium acetyl acetonate compound and a silane coupling agent.

That is, these and other objects of the present invention are accomplished with an electrophotographic photoreceptor comprising an undercoating layer provided on an electrically conductive substrate having thereon a light-sensitive layer wherein the undercoating layer is obtained by coating a solution of a composition comprising zirconium and silicon or a solution of a mixture of a zirconium acetyl acetonate compound and a silane coupling agent, the silicon content in the composition comprising zirconium and silicon is in the range of 5 to 35 mol % based on the total amount of zirconium and silicon, and the hardened undercoating layer obtained from the zirconium acetyl acetonate compound and silane coupling agent is a layer having a hardening degree of 1.2 or less.

BRIEF DESCRIPTION OF THE DRAWINGS

By way of example and to make the description more clear, reference if made to the accompanying drawings in which:

FIG. 1-(*a*) to FIG. 1-(*c*) are diagrammatic sectional views of an embodiment of an electrophotographic photoreceptor of the present invention; and In FIG. 1-(*a*) to FIG. 1-(*c*), Numeral 1 represents an electrically conductive substrate; Numeral 2 represents an undercoating layer; Numeral 3 represents a charge-generating layer; Numeral 4 represents a charge-transporting layer and Numeral 5 represents a single light-sensitive layer.

DETAILED DESCRIPTION OF THE INVENTION

Figure 2:
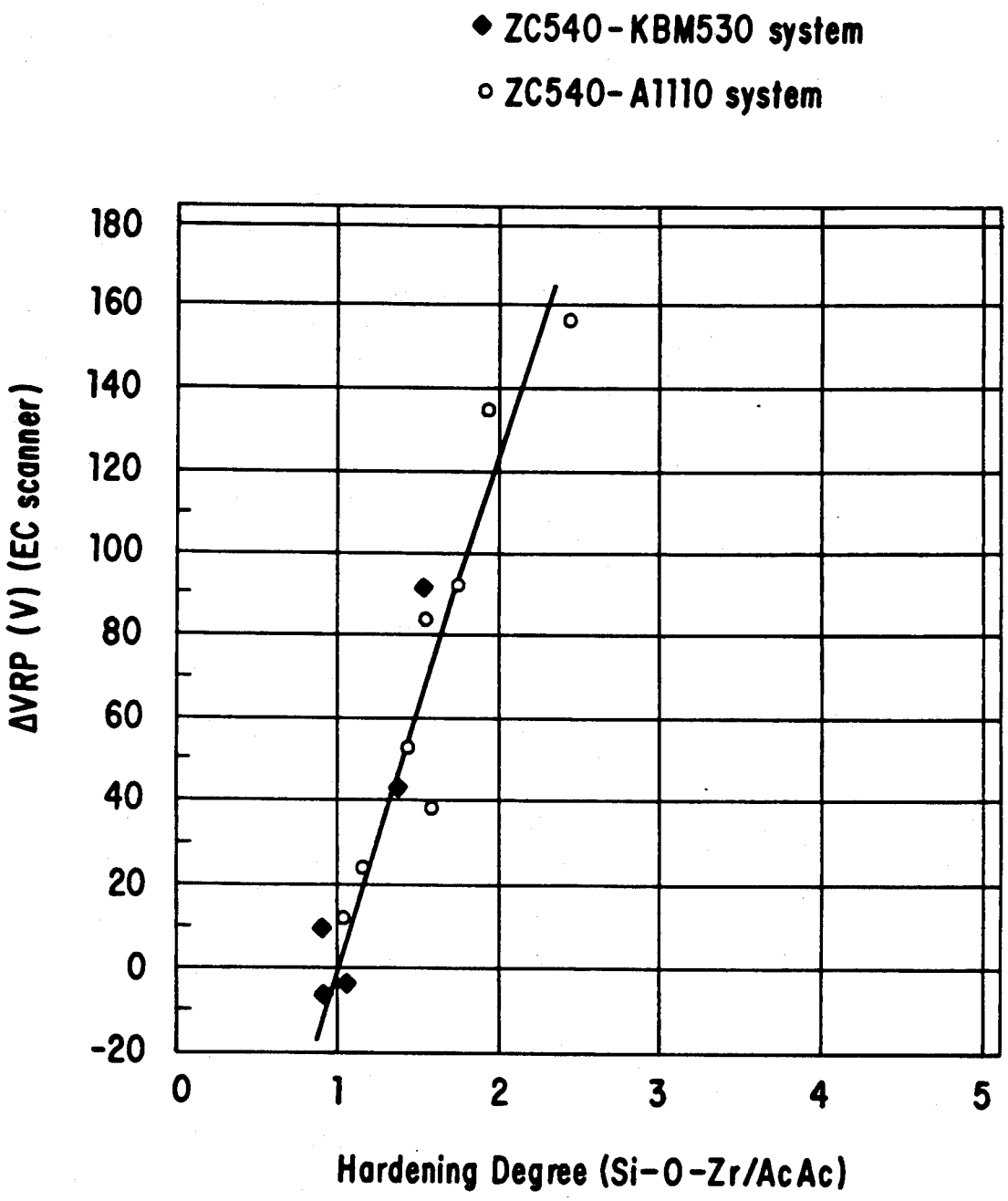
FIG. 2 is a graph illustrating the relationship between the hardening degree of the undercoating layer and the residual potential thereon in an embodiment of the present invention.

The present invention will be further described hereinafter.

In the present invention, as an electrically conductive substrate there may be used a known material. Preferred examples of such a known material include aluminum and stainless steel.

An undercoating layer is formed on the electrically conductive substrate.

When the undercoating layer is formed by a composition comprising zirconium and silicon, it is a coating film formed by an inorganic high molecular substance containing zirconium and silicon. The coating film formed by such an inorganic high molecular substance can be formed by coating and then hardening a solution containing a zirconium compound and a silane coupling agent. Typical examples of such a zirconium compound include zirconium chelate compound. As such a zirconium chelate compound, a compound having 3, 4, 6 or 8 molecular coordinations represented by the following formula is preferably used:

$$M\ (ZrX_{3,4,6,8})$$

wherein M represents a metallic ion such as $Cu^{2+}$, $Ag^{+}$, $Hg^{2+}$ and $Au^{3+}$ or hydrogen ion (valence omitted); and X represents a halogen atom such as F, Cl, Br and I, acetylacetone, ketoester, aminoalcohol, glycol, hydroxy acid or amino acid residue.

Typical examples of such a zirconium chelate compound include zirconium tetraacetyl acetonate, zirconium trilactate, zirconium tetraoxalate, hexafluoro zirconium, and octafluoro zirconium.

Other examples of such a zirconium chelate compound include zirconium alkoxides. Zirconium alkoxides are represented by the following formula:

$$Zr\text{-}(OR)_4$$

wherein R represents an alkyl group (preferably having 3 to 8 carbon atoms). Typical examples of the zirconium alkoxides include zirconium tetraethoxide, zirconium tetrapropoxide, and zirconium tetrabutoxide.

Alternatively, the zirconium compound may be formed by both a chelate component and an alkoxide component. Examples of such a zirconium compound include zirconium tributoxy acetyl acetonate, zirconium dibutoxy bisacetyl acetonate, and zirconium butoxy trisethyl acetoacetate.

These zirconium compounds may be used in admixture of two kinds or more.

Examples of silane coupling agents include vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylpropyltrimethoxysilane, γ-mercaptopropyltrimethoxysilane, γ-ureidopropyltriethoxysilane, γ-aminopropyltrimethoxysilane and β-3,4-epoxycyclohexylethyltrimethoxysilane.

Among these, a solution containing zirconium tributoxy acetyl acetonate as a zirconium compound and γ-aminopropyltrimethoxysilane as a silane coupling agent is preferred for a coating solution of the undercoating layer.

In the present invention, the mixing proportion of zirconium compound and silane coupling agent is predetermined such that the silicon content in the undercoating layer is in the range of 5 to 35 mol % (preferably 25 to 35 mol %) based on the total amount of zirconium and silicon in the undercoating layer. In the present invention, the mixing proportion of zirconium compound and silane coupling agent can be defined on the basis of the weight of the two components charged during the preparation of the coating solution. If the silicon content exceeds the above specified range, the volume resistivity of the undercoating layer is increased, causing troubles such as increase in the residual potential upon repeating use.

If a silane coupling agent is incorporated in the coating solution, the coating solution exhibits improvements in its uniformity and adhesion to substrate and light-sensitive layer. Therefore, when an undercoating layer is formed, the silicon content should be predetermined to the above specified range by properly mixing a silane coupling agent into the system.

When the undercoating layer is formed by a solution of a mixture of a zirconium acetyl acetonate compound and a silane coupling agent, the "hardening degree" of the coating film thus obtained means the ratio (B/A) of the intensity (A) of the infrared absorption peak of acetyl acetone ($CH_3COCHCOCH_3$) in the zirconium acetyl acetonate compound in the vicinity of 1,380 $cm^{-1}$ to the intensity (B) of the infrared absorption peak of Si-O-Zr in the product after hardening reaction of a coating film of the above mentioned solution in the vicinity of 940 $cm^{-1}$. Some silane coupling agents exhibit a strong peak in the vicinity of 1,380 $cm^{31\ 1}$. In this case, the intensity (A) should be corrected before determining hardening degree.

The undercoating layer formed on the electrically conductive substrate is a coating film formed by coating and then hardening a solution of a mixture of a zirconium acetyl acetonate compound and a silane coupling agent in such a manner that the resulting hardening degree reaches 1.2 or less (preferably 1 to 1.2). If the hardening degree of the undercoating layer exceeds 1.2, the finished electrophotographic photoreceptor is easily influenced by environmental or cycle fluctuation.

In the present invention, the mixing proportion of zirconium acetyl acetonate compound and silane coupling agent is preferably in the range of 2/1 to 4/1 as calculated in terms of Zr/Si. If the proportion of Zr exceeds the above specified range, the wetting properties are deteriorated during the coating of a charge-generating layer, resulting in the formation of uneven coating film. On the contrary, if the proportion of Si exceeds the above specified range, it disadvantageously increases the residual potential. Even if no silane coupling agent is incorporated in the system, an undercoating layer can be formed, though with a great deterioration in film-forming properties and adhesion. Thus, it is necessary that a zirconium acetyl acetonate compound be used in combination with a silane coupling agent.

The zirconium acetyl acetonate compound to be used in the present invention is represented by the following formula:

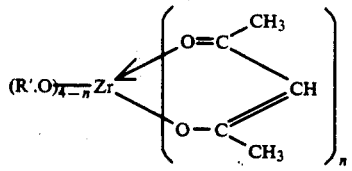

wherein R' represents an alkyl group having 1 to 5 carbon atoms; and n represents an integer 1 to 4.

Typical examples of such a zirconium acetyl acetonate compound include zirconium tetraacetyl acetonate, zirconium dipropoxydiacetyl acetonate, and tributoxyzirconium acetyl acetonate.

As silane coupling agents there can be used those described above.

In the present invention, the thickness of the undercoating layer is normally predetermined to 0.01 to 5 μm, preferably 0.05 to 1 μm, more preferably 0.05 to 0.2 μm. In order to form an undercoating layer, it is necessary to prepare a coating solution thereof. As solvents for dissolving the above mentioned zirconium compound and silane coupling agent there can be used alcohols such as ethanol, methanol, propanol and butanol, aromatic hydrocarbons such as toluene, and esters such as ethyl acetate and cellosolve acetate, singly or in combination.

For coating of such a coating solution, any suitable coating method such as a dip coating method, a spray coating method, a blade coating method, a spinner coating method, a bead coating method and a curtain coating method may be used. For drying of the coat film, an air blow drying or a stationary drying can be effected at a temperature of 110° to 250° C., preferably 120° to 200° C. and more preferably 135° to 180° C. for 5 minutes to 6 hours, preferably 5 minutes to 2 hours and more preferably 7 minutes to 15 minutes.

The drying temperature and drying time need to meet the above mentioned heat hardening requirements.

The heat hardening of the coating film of undercoating layer may be effected immediately after coating or may be effected by heating which is effected for the formation of a light-sensitive layer on the undercoating layer.

On the undercoating layer is formed a light-sensitive layer. The light-sensitive layer may be in the form of single layer or lamination layer. Examples of such a single layer structure include dye-sensitized ZnO light-sensitive layer, dye-sensitized CdS light-sensitive layer, and light-sensitive layer comprising a charge-generating substance dispersed in a charge-transporting substance.

Examples of the above mentioned lamination structure include those comprising layers which are function-separated into charge-generating layer and charge-transporting layer. The order of lamination of the charge-generating layer and charge-transporting layer on the electrically conductive substrate may be arbitrary.

The charge-generating layer may be formed by dispersing a charge-generating substance in a binder resin as necessary. Examples of such a charge-generating substance include selenium, a selenium alloy, an inorganic photoconductive substances such as CdS, CdSe, CdSSe, ZnO and ZnS, a metal or non-metal phthalocyanine pigment, an azo pigment such as bisazo pigment and trisazo pigment, a squarium compound, an azlenium compound, a perylene pigment, an indigo pigment, a quinacridone pigment, a polycyclic quinone pigment, a cyanine dye, a xanthene dye, charge-transfer complex made of poly-N-vinylcarbazole and trinitrofluorenone, etc., and an eutectic complex made of pyrylium salt dye and polycarbonate resin, etc.

As binding resin there can be used any known binder resin such as polycarbonate, polystyrene, polyester, polyvinyl butyral, methacrylic ester polymer or copolymer, acetic vinyl polymer or copolymer, cellulose ester or ether, polybutadiene, polyurethane and epoxy resin.

The charge-transporting layer may be mainly composed of a charge-transporting substance. The charge-transporting substance is not specifically limited. As such a substance there can be used any substance transparent to visible light capable of transporting electric charge. Specific examples of such a substance include imidazole, pyrazoline, thiazole, oxadiazole, oxazole, hydrazine, ketazine, azine, carbazole, polyvinyl carbazole, derivative thereof, triphenylamine derivative, stilbene derivative, and benzidine derivative. As necessary, such a substance can be used in combination with a binder resin. Examples of such a binder resin include polycarbonate, polyarylate, polyester, polystyrene, styrene-acrylonitrile copolymer, polysulfone, polymethacrylic ester, and styrene-methacrylic ester copolymer.

The present invention will be further described in the following examples, but the present invention should not be construed as being limited thereto.

EXAMPLE I-1

A coating solution for an undercoating layer having the following composition was prepared.

| | |
|---|---|
| Zirconium tetraacetyl acetonate ("ZC150" manufactured by Matsumoto Kosho K.K.) | 10 parts by weight |
| γ-(2-Aminoethyl)aminopropyl trimethoxysilane ("SH6020" manufactured by Toray Silicone K.K.) | 0.5 parts by weight |
| Methyl alcohol | 75 parts by weight |
| n-Butyl alcohol | 25 parts by weight |

The coating solution thus prepared was coated on an aluminum pipe by a dip coating method, and then dried at a temperature of 150° C. for 10 minutes to form a 0.1 μm thick undercoating layer.

87 parts by weight of granular trigonal selenium and a solution of 13 parts by weight of a vinyl chloride-vinyl acetate copolymer ("Solution Vinyl VMCH" manufactured by Union Carbide) dissolved in 200 parts by weight of n-butyl acetate were dispersed by means of an attritor for 24 hours. 30 parts by weight of the thus obtained dispersion were then diluted with 57 parts by weight of n-butyl acetate to obtain a dip coating solution.

The dip coating solution was dip-coated on the undercoating layer coated on the aluminum pipe, and then dried at a temperature of 100° C. for 5 minutes to form a charge-generating layer having a thickness of about 0.1 μm thereon.

10 parts by weight of N,N'-diphenyl-N,N'-bis(3-methylphenyl)-[1,1'-biphenyl]-4,4'-diamine and 10 parts by weight of a polycarbonate Z resin were dissolved in 80 parts by weight of monochlorobenzene to prepare a charge-transporting layer coating solution. The coating solution was coated on the charge-generating layer, and then hot-air dried at a temperature of 100° C. for 60 minutes to form a 25-μm thick charge-transporting layer.

The thus prepared electrophotographic photoreceptor was then mounted on a copying machine ("remodelled version of FX5030", manufactured by Fuji Xerox). The copying machine was adjusted so that the dark potential VD reached −800 V. The bright potential VL developed at an exposure of 2 erg/cm$^2$ was then measured. For durability test, 100,000 copies were made. The change in the dark potential VD and the bright potential VL were measured. At the same time, the image quality was evaluated. The results are shown in Table I-1.

EXAMPLE I-2

An electrophotographic photoreceptor was prepared in the same manner as in Example I-1 except that the mixing proportion of zirconium tetraacetyl acetonate and γ-(2-aminoethyl)aminopropyltrimethoxysilane was 3:1 (molar ratio). The thus prepared sample was evaluated in the same manner as in Example I-1. The results are shown in Table I-1.

COMPARATIVE EXAMPLE I-1

An electrophotographic photoreceptor was prepared in the same manner as in Example I-1 except that the mixing proportion of zirconium tetraacetyl acetonate and γ-(2-aminoethyl)aminopropyltrimethoxysilane was 3:2 (molar ratio). The thus prepared sample was evaluated in the same manner as in Example I-1. The results are shown in Table I-1.

COMPARATIVE EXAMPLE I-2

An electrophotographic photoreceptor was prepared in the same manner as in Example I-1 except that the mixing proportion of zirconium tetraacetyl acetonate and γ-(2-aminoethyl)aminopropyltrimethoxysilane was 1:1 (molar ratio). The thus prepared sample was evaluated in the same manner as in Example I-1. The results are shown in Table I-1.

EXAMPLE I-3

An electrophotographic photoreceptor was prepared in the same manner as in Example I-1 except that the undercoating layer coating solution had the composition as described later. The thus prepared sample was evaluated in the same manner as in Example I-1. The results are shown in Table I-1.

| | |
|---|---|
| 50 wt % Solution of tributoxyzirconium acetyl acetonate ("ZC540" manufactured by Matsumoto Kosho K.K.) | 10 parts by weight |
| γ-Aminopropyltrimethoxysilane ("A1110" manufactured by Nihon Unicar K.K.) | 0.24 parts by weight |
| Ethyl alcohol | 75 parts by weight |
| n-Butyl alcohol | 25 parts by weight |

EXAMPLE I-4

An electrophotographic photoreceptor was prepared in the same manner as in Example I-3 except that the mixing proportion of tributoxyzirconium acetyl acetonate and δ-aminopropyltrimethoxysilane was 3:1 (molar ratio). The thus prepared sample was evaluated in the same manner as in Example I-3. The results are shown in Table I-1.

COMPARATIVE EXAMPLE I-3

An electrophotographic photoreceptor was prepared in the same manner as in Example I-3 except that the mixing proportion of tributoxyzirconium acetyl acetonate and δ-aminopropyltrimethoxysilane was 1:1 (molar ratio). The thus prepared sample was evaluated in the same manner as in Example I-3. The results are shown in Table I-1.

COMPARATIVE EXAMPLE I-4

An electrophotographic photoreceptor was prepared in the same manner as in Example I-3 except that no silane coupling agent was used. The thus prepared sample was evaluated in the same manner as in Example I-3. The results are shown in Table I-1.

EXAMPLE I-5

An electrophotographic photoreceptor was prepared in the same manner as in Example I-3 except that the mixing proportion of tributoxyzirconium acetyl acetonate and δ-aminopropyltrimethoxysilane was 2:1 (molar ratio). The thus prepared sample was evaluated in the same manner as in Example I-3. The results are shown in Table I-1.

TABLE I-1

| Example | Silicon content (mol %) | Initial potential (V) -VL | Initial potential (V) -VRP | Potential (V) after copying of 100,000 sheets -VD | -VL | -VRP | Image quality |
|---|---|---|---|---|---|---|---|
| Example I-1 | 10 | 160 | 30 | 780 | 190 | 40 | G |
| Example I-2 | 25 | 160 | 40 | 780 | 200 | 50 | G |
| Comparative Example I-1 | 40 | 160 | 40 | 800 | 250 | 100 | B |
| Comparative Example I-2 | 50 | 170 | 40 | 820 | 300 | 120 | B |
| Example I-3 | 10 | 150 | 30 | 750 | 190 | 30 | G |
| Example I-4 | 25 | 150 | 30 | 760 | 200 | 30 | G |
| Comparative Example I-3 | 50 | 150 | 30 | 780 | 260 | 80 | B |
| Comparative Example I-4 | 0 | 140 | 20 | 750 | 190 | 30 | B |
| Example I-5 | 33 | 160 | 35 | 780 | 220 | 60 | G |

As is apparent from the results of Table I-1, the electrophotographic photoreceptor of the present invention comprising an undercoating layer containing a predetermined proportion of zirconium and silicon exhibits excellent electrophotographic properties, i.e., reduced dark decay, excellent chargeability, reduced drop in development contrast, decreased residual potential, reduced environmental fluctuation and excellent durability. Therefore, when subjected to continuous copying of a large number of sheets, the electrophotographic photoreceptor of the present invention exhibits stable electrophotographic properties and provides stable images scarcely having image defects such as white pepper, black pepper, roughness and pinhole.

EXAMPLES II-1 to II-4 and COMPARATIVE EXAMPLES II-1 and II-2

| | |
|---|---|
| 50% Toluene solution of tributoxyzirconium acetyl acetonate ("ZC540" manufactured by Matsuomoto Kosho K.K.) | 90 parts by weight |
| γ-Methacryloxypropyl trimethoxye silan ("KMB503" manufactured by The Shin-Etsu Chemical Industry Co., Ltd.) | 11 parts by weight |
| i-Propyl alcohol | 400 parts by weight |
| n-Butyl alcohol | 200 parts by weight |

The above mentioned components were stirred by a stirrer to prepare an undercoating layer coating solution. The coating solution was dip-coated on the surface of an aluminum cylinder having a diameter of about 85 mm, air-dried for about 5 minutes, and then heat-dried. The drying time varied from 7 minutes to 90 minutes, and the drying temperature was varied from 150° C. to 180° C. so that an undercoating layers having different hardening degree (Nos. 1 to 6) were obtained (see FIG. 2). The thickness of the undercoating layers was about 0.1 μm.

87 parts by weight of granular trigonal selenium and a solution of 13 parts by weight of a vinyl chloride-vinyl acetate copolymer ("Solution Vinyl VMCH" manufactured by Union Carbide) dissolved in 200 parts by weight of n-butyl acetate were dispersed by means of an attritor for 48 hours. 30 parts by weight of the thus obtained dispersion were then diluted with 57 parts by weight of n-butyl acetate to obtain a dip coating solution.

The dip coating solution was dip-coated on the undercoating layer coated on the aluminum cylinder, and then dried at a temperature of 100° C. for 5 minutes to form a charge-generating layer having a thickness of about 0.1 μm thereon.

10 parts by weight of N,N'-diphenyl-N,N'-bis(3-methylphenyl)-[1,1'-biphenyl]-4,4'-diamine and 10 parts by weight of a polycarbonate Z resin were dissolved in 80 parts by weight of monochlorobenzene to prepare a charge transporting layer coating solution. The coating solution was coated on the charge-generating layer, and then hot-air dried at a temperature of 100° C. for 60 minutes to form a 25-μm thick charge-transporting layer.

The thus prepared electrophotographic photoreceptor was adjusted so that the dark potential reached −800 V in an EC scanner. The sample was then measured for electrical properties at 3,000 cycle. Among the samples thus tested, those attaining good results were then mounted on a copying machine ("remodelled version of FX5030", manufactured by Fuji Xerox). The copying machine was adjusted so that the dark potential $V_{DDP}$ reached −800 V. The bright potential VL developed at an exposure of 2 erg/cm$^2$ was then measured. For durability test, 200,000 copies were made. The change in the dark potential $V_{DDP}$ and the residual potential $V_{RP}$ were measured. At the same time, image quality was evaluated. The results are shown in Table II-1.

EXAMPLES II-5 and II-6 and COMPARATIVE EXAMPLES II-3 to II-8

| | |
|---|---|
| 50% Toluene solution of tributoxyzirconium acetyl acetonate ("ZC540" manufactured by Matsuomoto Kosho K.K.) | 100 parts by weight |
| γ-Aminopropyltrimethoxysilane ("A1110" manufactured by Nihon Unicar K.K.) | 11 parts by weight |
| i-Propyl alcohol | 440 parts by weight |
| n-Butyl alcohol | 220 parts by weight |

The above mentioned components were stirred by a stirrer to prepare an undercoating layer coating solution. The coating solution was dip-coated in the same manner as in Example II-1, air-dried for about 3 minutes, and then heat-dried. The drying time and the drying temperature was varied in the same manner as in Example II-1 so that the undercoating layers having different hardening degree (Nos. 7 to 14) were obtained (see FIG. 2). An electrophotographic photoreceptor was then prepared in the same manner as in Example II-1. The sample was evaluated in the same manner as in Example II-1. The results are shown in Table II-1.

TABLE II-1

| Example | Test No. | Drying conditions: Temperature (°C.) | Drying conditions: Time (min.) | Hardening Degree | EC scanner ΔVRP (V) | After copying of 200,000 sheets: ΔVDDP (V) | After copying of 200,000 sheets: ΔVRP (V) | After copying of 200,000 sheets: Image quality |
|---|---|---|---|---|---|---|---|---|
| Example II-1 | 1 | 150 | 10 | 0.94 | −5 | −10 | 5 | No problem |
| Example II-2 | 2 | 150 | 40 | 0.94 | 9 | — | — | — |
| Example II-3 | 3 | 150 | 90 | 1.00 | 10 | — | — | — |
| Example II-4 | 4 | 180 | 10 | 1.09 | −2 | — | — | — |
| Comparative Example II-1 | 5 | 180 | 40 | 1.40 | 42 | — | — | — |
| Comparative Example II-2 | 6 | 180 | 90 | 1.57 | 93 | — | — | — |
| Example II-5 | 7 | 150 | 7 | 1.01 | 14 | 0 | 10 | No problem |
| Example II-6 | 8 | 150 | 10 | 1.20 | 25 | −5 | 5 | No problem |
| Comparative Example II-3 | 9 | 150 | 15 | 1.41 | 55 | 0 | 45 | Fog occurs |
| Comparative | 10 | 150 | 40 | 1.51 | 83 | — | — | — |

TABLE II-1-continued

| Example | Test No. | Drying conditions Temperature (°C.) | Drying conditions Time (min.) | Hardening Degree | EC scanner ΔVRP (V) | After copying of 200,000 sheets ΔVDDP (V) | After copying of 200,000 sheets ΔVRP (V) | After copying of 200,000 sheets Image quality |
|---|---|---|---|---|---|---|---|---|
| Example II-4 | | | | | | | | |
| Comparative Example II-5 | 11 | 150 | 90 | 1.78 | 93 | — | — | — |
| Comparative Example II-6 | 12 | 180 | 10 | 1.61 | 39 | — | — | — |
| Comparative Example II-7 | 13 | 180 | 40 | 1.92 | 135 | — | — | — |
| Comparative Example II-8 | 14 | 180 | 90 | 2.48 | 158 | — | — | — |

As is apparent from the results of Table II-1, the electrophotographic photoreceptor having the undercoating layer comprising both a zirconium acetyl acetonate compound and a silane coupling agent to exhibit a specific hardening degree of the present invention exhibits excellent electrophotographic properties, i.e., reduced dark decay, excellent chargeability, reduced residual potential, reduced environmental fluctuation and excellent durability.

COMPARATIVE EXAMPLE III-1

In accordance with the conditions described in Example 1 of JP-A-59-223439, a coating solution was prepared, i.e., from the following components:

| | |
|---|---|
| Zirconium tetraacetyl acetonate | 1 part by weight |
| Methyltrimethoxysilane | 1 part by weight |
| Isopropyl alcohol | 30 parts by weight |
| n-Butyl alcohol | 5 parts by weight |

The thus prepared coating solution was coated on an aluminum sheet, and then dried at a temperature of 40° C. for 2 hours to obtain an interlayer having a thickness of 0.3 μm. The sample was subjected to trace test. However, the following problems occurred.

1) In a solvent system consisting of isopropyl alcohol and n-butyl alcohol, zirconium tetraacetyl acetonate cannot be dissolved to prepare a coating solution.

2) When zirconium tetraacetyl acetonate is coated on the substrate in the form of solution in a solvent other than isopropyl alcohol or n-butyl alcohol, even if it is dried at a temperature of 40° C., which is specified in Examples of JP-A-59-223439, for up to 4 hours, hardening degree which gives enough solvent resistance cannot be obtained. Thus, it is considered that the resulting undercoating layer is subjected to dissolution when coated with a layer thereon.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an undercoating layer provided on an electrically conductive substrate having thereon a light-sensitive layer, wherein said undercoating layer is obtained by coating a solution of a composition comprising zirconium and silicon or a solution of a mixture of a zirconium acetyl acetonate compound and a silane coupling agent, the silicon content in said composition comprising zirconium and silicon being in the range of 5 to 35 mol % based on the total amount of zirconium and silicon, and said undercoating layer obtained from said zirconium acetyl acetonate compound and silane coupling agent being a layer having a hardening degree of 1.2 or less.

2. The electrophotographic photoreceptor of claim 1, wherein said composition comprising zirconium and silicon is a solution comprising a zirconium compound and a silane coupling agent.

3. The electrophotographic photoreceptor of claim 1, wherein said undercoating layer has a thickness of 0.01 to 5 μm.

4. The electrophotographic photoreceptor of claim 1, wherein said undercoating layer is obtained by coating a solution containing zirconium tributoxy acetyl acetonate as a zirconium compound and γ-aminopropyltrimethoxysilane as a silane coupling agent.

* * * * *